US005585693A

United States Patent [19]

Shaffer

[11] Patent Number: 5,585,693

[45] Date of Patent: Dec. 17, 1996

[54] FLUORESCENT LAMP WITH END OF LIFE ARC QUENCHING STRUCTURE

[75] Inventor: John W. Shaffer, Danvers, Mass.

[73] Assignee: Osram Sylvania Inc., Danvers, Mass.

[21] Appl. No.: 503,776

[22] Filed: Jul. 18, 1995

Related U.S. Application Data

[63] Continuation-in-part of Ser. No. 389,995, Feb. 17, 1995, abandoned.

[51] Int. Cl.[6] ..... H01J 1/62; H01J 17/04; H01J 5/50

[52] U.S. Cl. ..... 313/489; 313/631; 313/626; 313/331

[58] Field of Search ..... 313/489, 631, 313/626, 331, 490, 491

[56] References Cited

U.S. PATENT DOCUMENTS

| | | | |
|---|---|---|---|
| 3,560,790 | 2/1971 | Vollmer | 313/218 |
| 3,629,916 | 12/1971 | Vollmer | 29/25.17 |
| 3,840,324 | 10/1974 | Shaffer et al. | 431/93 |
| 4,055,686 | 10/1977 | Steinberg et al. | 427/124 |
| 5,098,326 | 3/1992 | Gorczyca et al. | 445/26 |
| 5,278,473 | 1/1994 | Parks | 313/540 |

*Primary Examiner*—Sandra L. O'Shea
*Assistant Examiner*—John Ning
*Attorney, Agent, or Firm*—Carlo S. Bessone

[57] ABSTRACT

A fluorescent lamp comprises a glass tube, an electrode at each end of the tube, each of the electrodes including a pair of lead wires extending through each sealed end of the tube and joined to a coil, and a capsule containing metal hydride disposed in the tube and having a decomposition temperature higher than temperatures within the tube during normal operation of the lamp.

20 Claims, 4 Drawing Sheets

FLUORESCENT LAMP WITH END OF LIFE ARC QUENCHING STRUCTURE

CROSS-REFERENCE TO RELATED APPLICATION

This is a continuation-in-part of application Ser. No. 08/389,995, filed Feb. 17, 1995 now abandoned, in the name of John W. Shaffer.

BACKGROUND OF THE INVENTION

1. Field of the Invention

The invention relates to fluorescent lamps, and is directed more particularly to a fluorescent lamp having therein means for quenching the arc in the lamp at the end of lamp life.

2. Description of the Prior Art

Fluorescent lamps are increasingly being used with electronic ballasts that operate the lamp at high frequencies. Often such ballasts are of the "instant start" type wherein the open circuit voltage is sufficiently high to ignite the lamp directly, without the need for a separate cathode heating current.

The end of lamp life occurs when one of the electrodes is depleted of its emissive coating. At power line frequencies and with low open circuit voltage ballasts, the lamp arc is passively extinguished when the first electrode fails. However, in the case of electronic instant start ballasts, the lamp arc does not necessarily extinguish when the first electrode fails. The open circuit voltage provided by instant start ballasts is sufficiently high to cause the lamp to continue to operate in a "cold cathode" mode. During cold cathode operation, the cathode voltage rises from around 12 volts to 50 volts, or higher.

Referring to FIGS. 1 and 2, in a lamp 2 having electrodes 4, 6 at either end of a glass tube 8, respectively, upon failure of the first electrode 6, ion bombardment heats the tungsten coil 10, lead wires 12, 14, and any other electrically connected metallic structures within the glass tube 8. The heating of the metallic components is to such a high temperature that the components provide sufficient thermionic and secondary electron emissions to sustain the arc. Wattage dissipation in the failed lamp end greatly increases. As a result, the end of the tube 8 heats far above its normal operating temperature. The lead wires 12, 14 within the envelope 8 often become molten and melt through the envelope and/or cause the envelope to crack and sometimes break upon removal of the lamp from a fixture. The excessive heating of the lamp end can also cause damage to a socket or lamp fixture in which the lamp is mounted, or melting of a plastic lamp base 16.

To alleviate the problem, instant start electronic ballasts have been designed with additional circuitry to sense a rise in lamp voltage, or other events occurring upon cathode depletion, and shut down the system. However, such additional electronic components significantly increase the cost of the ballast. Further, many ballasts which do not include such a feature already exist in present lamp installations.

Accordingly, there exists a need for a fluorescent lamp which self-contains means for arc shut-down at the end of life of the lamp, which shut-down means does not include or require additional circuitry or electronic components.

SUMMARY OF THE INVENTION

An object of the invention is, therefore, to provide a fluorescent lamp having means therein for causing arc shut-down at the end of lamp life.

A further object of the invention is to provide a fluorescent lamp having such means for arc shut-down wherein the shut-down means requires no additional circuitry or electronic components.

With the above and other objects in view, as will hereinafter appear, a feature of the invention is the provision of a fluorescent lamp comprising a glass tube, an electrode at each end of the tube, each of the electrodes comprising a pair of lead wires extending through a sealed end of the tube and joined to a coil, and a capsule containing metal hydride powder disposed in the tube and having a decomposition temperature higher than temperatures within the tube during normal operation of the lamp.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
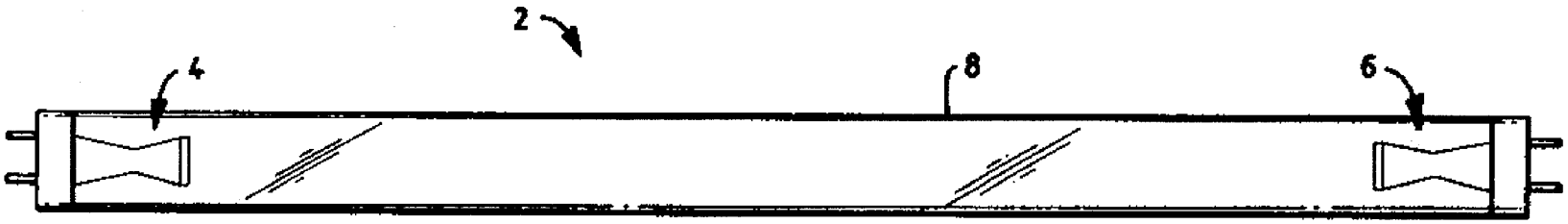
PRIOR ART FIG. 1
FIG. 1 is a side elevational view of a prior art fluorescent lamp.
Figure 2:
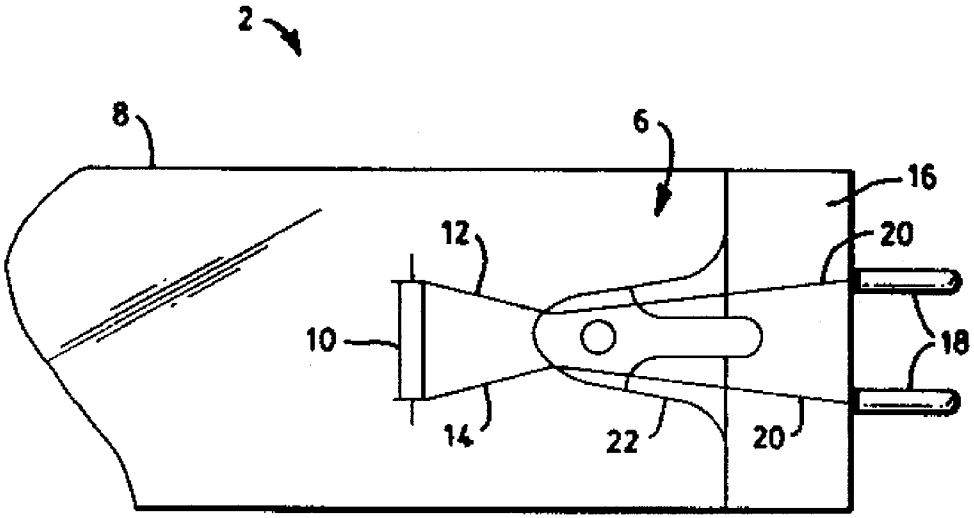
PRIOR ART FIG. 2
FIG. 2 is an enlarged diagrammatic view of an end portion of the lamp of FIG. 1.
Figure 3:
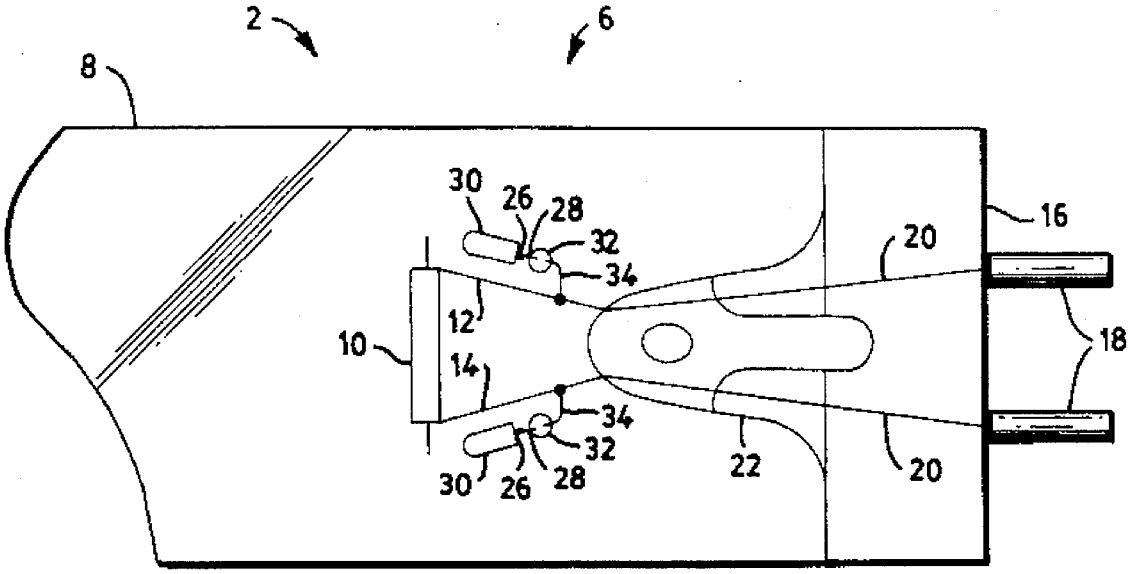
FIG. 3 is similar to FIG. 2, but shows one form of fluorescent lamp illustrative of an embodiment of the invention.

Referring to FIG. 3, there is shown a fluorescent lamp 2 comprising a glass tube 8. An electrode 4, 6, (one shown in FIG. 3) is disposed at each end of the tube 8. A pair of lead wires 12, 14 extend through each sealed end of the tube and are joined to a coil 10 to form the electrodes. A capsule 30, containing metal hydride powder, is disposed in the tube 8 and is provided with a decomposition temperature higher than temperatures within the tube 8 during normal operation of the lamp. It will be seen that the electrode 6 is similar to that shown in FIG. 2, but has disposed on each of the lead wires 12, 14 the metal hydride-containing capsule 30.

In operation, at the end of the lamp life, caused by depletion of the cathode coating at one end of the lamp, the coil 10 in that end of the lamp rises to a temperature much higher than its normal operating temperature. Radiant heat from one or both of the lead wires 12, 14 raises the temperature in the tube 8 from a normal operating temperature of about 150° C., or less, to about 650° C., or greater, thereby raising the temperature of the metal hydride capsule 30 such that the contents of the capsule are thermally decomposed and hydrogen gas passes from the capsule into the lamp through the capsule crimped closure, to be further described herein below. The presence of hydrogen in the tube 8 raises the voltage required to sustain the discharge well above that provided by instant start ballasts, causing the lamp to go out passively, without significant end heating or glass cracking. The hydrogen release occurs rapidly enough to prevent damage to a fixture retaining the affected lamp. The quantity of hydrogen released, typically about three Torr-liters from a twelve milligram capsule, is sufficient to quench the arc in larger fluorescent lamps.

Figure 4:
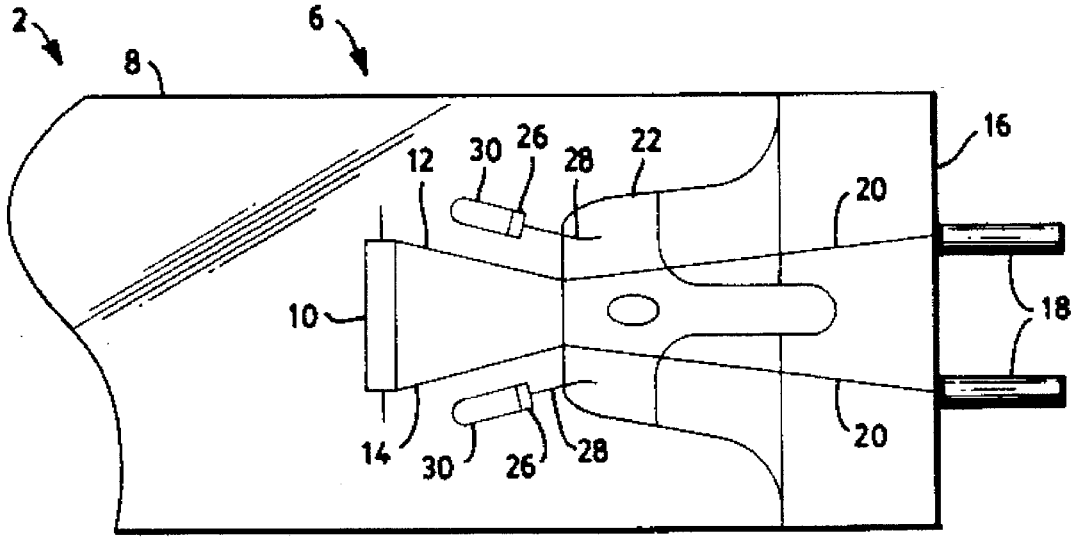
FIG. 4 is similar to FIG. 3, but shows another form of fluorescent lamp illustrative of an alternative embodiment of the invention.

Referring to FIG. 4, it will be seen that the capsules 30 may be fixed to a flare seal portion 22 of the pressware base portion 16 and, as in the FIG. 3 embodiment, extend generally parallel to their respective neighboring lead wires 12, 14. Thus, the capsules 30 are electrically insulated and are positioned proximate the lead wires. Upon failure of the coil 10, arcing continues down one of the lead wires 12, 14, raising the temperature in the envelope 8 well above normal operating temperature, causing thermal decomposition of the metal hydride powder within at least the capsule adjacent the arcing lead wire, with consequent passage of hydrogen gas into the envelope to quench the arc and terminate operation of the lamp.

Figure 5:
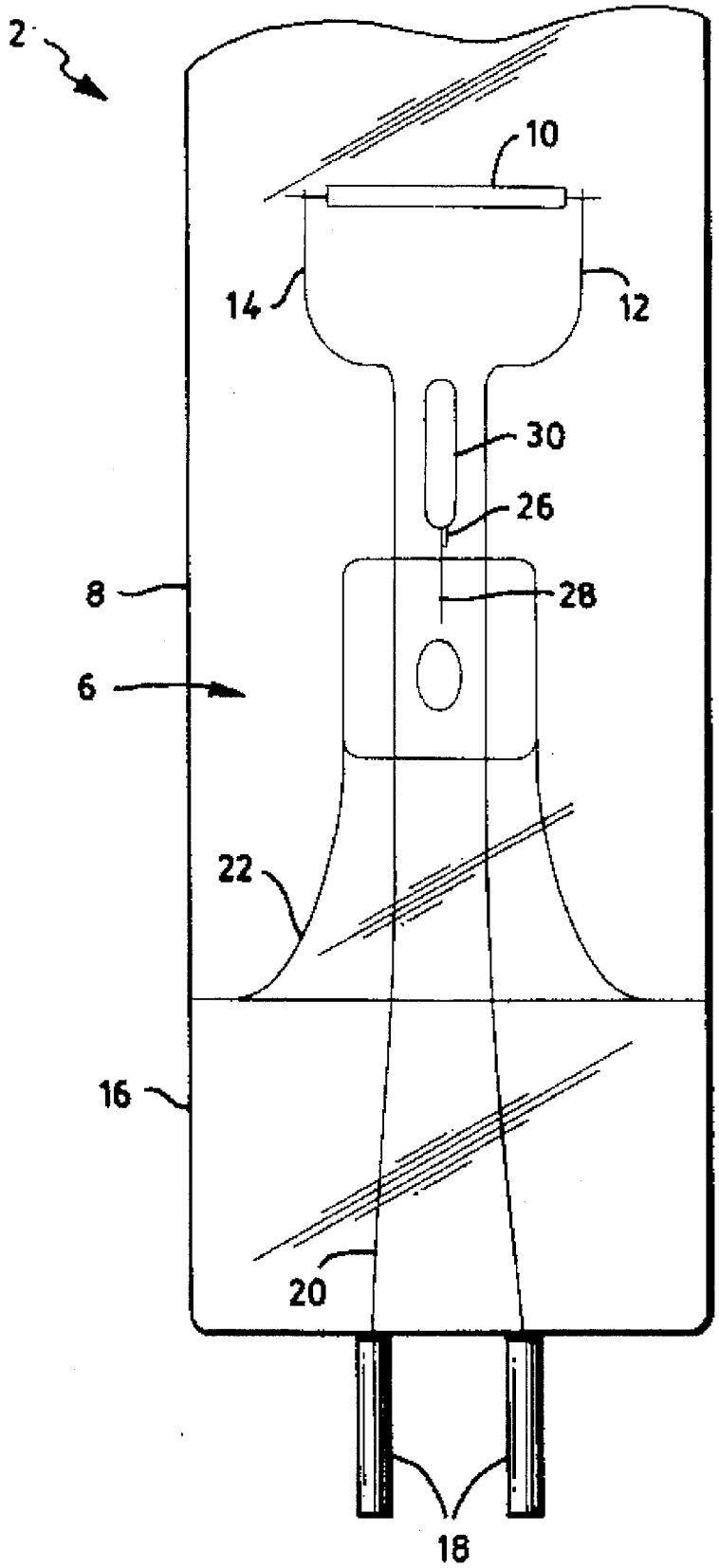
FIG. 5 is similar to FIG. 4, but shows another form of fluorescent lamp illustrative of another alternative embodiment of the invention.
Figure 6:
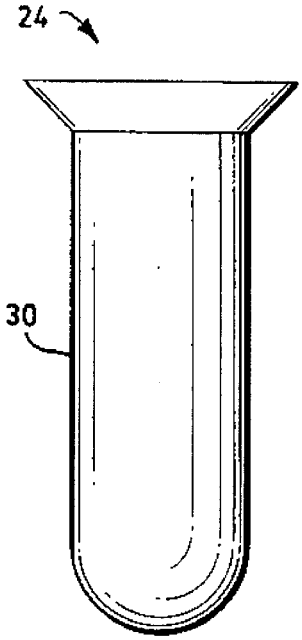
FIG. 6 is a side elevational view of a capsule filled but not crimped closed.

In FIG. 5, there is shown an alternative embodiment in which a single capsule 30 is mounted in the insulative glass flare portion 22 of the pressware base portion 16, and is disposed between the lead wires 12, 14, and generally parallel thereto. Again, when the cathode 10 fails, arcing along one of the lead wires 12, 14 raises the temperature of the capsule 30 sufficiently to thermally decompose the metal hydride in the capsule, to permit egress of hydrogen gas from the capsule and into the lamp envelope 8 to effect quenching.

The preferred metal hydride is titanium hydride, $TiH_{1.7}$. The metal hydride can be selected from a group including titanium, zirconium, hafnium, alloys of these metals with one another, and alloys of these metals with other metals such as cobalt, iron, nickel, manganese, lanthanum, or combinations of these other metals.

Figure 7:
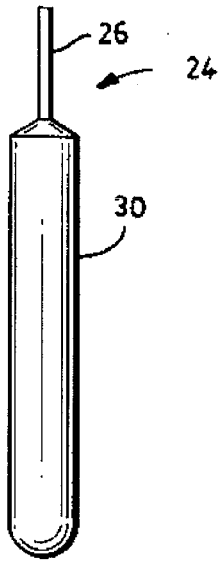
FIGS. 7 and 8 are side elevational and front views, respectively, of the capsule of FIG. 7 crimped closed.
Figure 8:
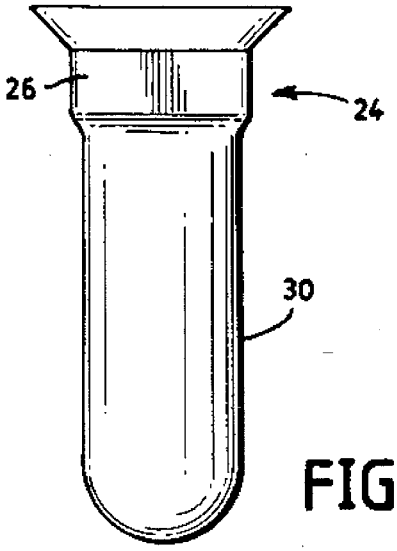

Referring to FIGS. 6–10, it will be seen that in manufacture, the capsule 30 is open (FIG. 6) only at a first end 24, which may be flared to ease entry of the powder. Once filled, the end 24 is crimped closed (FIGS. 7 and 8). The crimped closure is sufficient to prevent egress of powder from the capsule, but does not constitute a hermetic seal and permits egress of hydrogen gas from the capsule, the hydrogen being generated by the thermal decomposition of the metal hydride powder.

Figure 9:
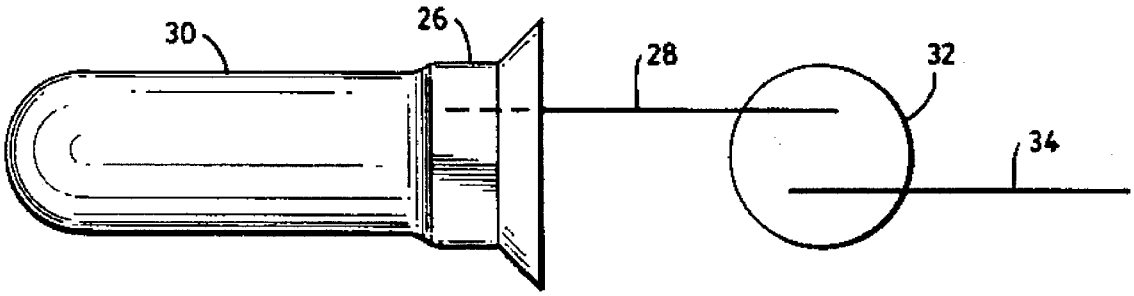
FIG. 9 is a side elevational view of the capsule of FIG. 8 having a first wire fixed thereto by which the capsule is fixed to an insulative glass bead which has a discrete second wire fixed thereto by which the bead and capsule are mounted in a fluorescent lamp as shown in FIG. 3.

Crimping the end 24 of the capsule 30 provides a generally planar tab 26 extending from the capsule to which there is spot welded a first mounting wire 28 (FIG. 9). In the embodiments shown in FIGS. 4 and 5, the mounting wire 28 free end is embedded in the lamp flare seal portion 22 to support the capsule in a position adjacent one or both of the lead wires 12, 14.

Alternatively, the free end of the mounting wire 28 is embedded in an electrically insulative glass bead 32 (FIG 9). Also embedded in the glass bead 32 is an end of a second mounting wire 34. The first and second mounting wires 28, 34 may be used to connect the capsule to a lead wire 12, 14 and position the capsule generally parallel to the lead wire (FIG. 3).

The capsule 30 preferably is of metal, such as steel, or an alloy. In one embodiment, the capsule is provided with a length of 0.240 inch, a diameter of 0.060 inch, and a wall thickness of 0.003 inch. A quantity of 12 (±1) milligrams of metal hydride powder is admitted to the capsule and closed therein.

There is thus provided a fluorescent lamp having means therein for causing shut-down at the end of lamp life, which means requires no additional circuitry or electronic components. The costs associated with the shut-down means are trivial and much lower than the cost of providing a shut-down circuit in the ballast, even though the ballast may survive several lamp lives.

It is to be understood that the present invention is by no means limited to the particular constructions herein disclosed and/or shown in the drawings, but also comprises any modifications or equivalents within the scope of the claims.

Having thus described my invention, what I claim as new and desire to secure by letters patent of the United States is:

1. A fluorescent lamp comprising:

a glass tube;

an electrode at each end of said tube, each of said electrodes comprising first and second lead wires extending through a sealed end of said tube and joined to a coil; and capsule means containing metal hydride powder connected to each of said electrodes in said tube, said powder having a decomposition temperature higher than temperatures within said tube during normal operation of said lamp.

2. The fluorescent lamp in accordance with claim 1 wherein said capsule means comprise first and second capsules in each of said electrodes.

3. The fluorescent lamp in accordance with claim 2 wherein each of said first and second capsules is connected, respectively, to said first and second lead wires.

4. The fluorescent lamp in accordance with claim 3 wherein said first and second capsules are attached to said first and second lead wires but are electrically insulated from said lead wires.

5. The fluorescent lamp in accordance with claim 4 wherein each of said capsules is connected to an insulative body, and said insulative body is connected to a respective one of said lead wires.

6. The fluorescent lamp in accordance with claim 5 wherein said insulative body comprises a glass bead.

7. The fluorescent lamp in accordance with claim 5 wherein said first capsule is disposed generally parallel to said first lead wire, and said second capsule is disposed generally parallel to said second lead wire.

8. The fluorescent lamp in accordance with claim 6 wherein a first wire interconnects said capsule and said glass bead, and a second wire interconnects said glass bead and said one lead wire.

9. The fluorescent lamp in accordance with claim 2 wherein each of said capsules is provided with a mounting wire extending therefrom, said mounting wire being embedded, at an end thereof remote from said capsule, in an insulative glass base portion of said lamp.

10. The fluorescent lamp in accordance with claim 9 wherein said first capsule extends generally parallel to said first lead wire, and said second capsule extends generally parallel to said second lead wire.

11. The fluorescent lamp in accordance with claim 1 wherein said capsule means comprises a capsule disposed between said first and second lead wires, and extending generally parallel thereto, said capsule being connected to an insulative glass base portion of said lamp, said capsule being electrically insulated from said lead wires.

12. The fluorescent lamp in accordance with claim 11 wherein said capsule has extending therefrom a mounting wire, said mounting wire being embedded, at an end thereof remote from said capsule, in an insulative glass flare portion of said glass base portion of said lamp.

13. The fluorescent lamp in accordance with claim 1 wherein said metal hydride powder contained in said capsule is a selected one from a group consisting of titanium, zirconium, hafnium, a titanium-zirconium alloy, a titanium hafnium alloy, and a zirconium-hafnium alloy.

14. The fluorescent lamp in accordance with claim 1 wherein said metal hydride comprises an alloy consisting of a selected one from a first group of materials consisting of titanium, zirconium, and hafnium, and alloys of said first group of materials, and a selected one from a second group of materials consisting of cobalt, iron, nickel, manganese, and lanthanum, and alloys of said second group of materials.

15. The fluorescent lamp in accordance with claim 1 wherein said metal hydride comprises titanium hydride.

16. The fluorescent lamp in accordance with claim 1 wherein said capsule is crimped closed so as to prevent escape of particles of said metal hydride powder therefrom, but is non-hermetically sealed, so as to permit escape of gas therefrom.

17. The fluorescent lamp in accordance with claim 14 wherein said capsule is closed such that said powder is prevented from escaping from said capsule, but is not hermetically sealed, such that gas may pass from said capsule.

18. The fluorescent lamp in accordance with claim 17 wherein said capsule is crimped closed at one end thereof, said one end being adapted to permit said passage of gas therethrough but not passage of said powder.

19. The fluorescent lamp in accordance with claim 18 wherein said crimped end includes a generally flat plate section to which a mounting wire is fixed.

20. A fluorescent lamp comprising:

a glass tube;

an electrode at each end of said tube; and a metal hydride disposed in each of said electrodes in said tube and having a decomposition temperature higher than temperatures within said tube during normal operation of said lamp.

* * * * *